US005116713A

United States Patent [19]

Uchida et al.

[11] Patent Number: 5,116,713

[45] Date of Patent: May 26, 1992

[54] TONER FOR DEVELOPING LATENT ELECTROSTATIC IMAGE

[75] Inventors: Masafumi Uchida; Toshiko Yajima; Hiroyuki Takagiwa; Jiro Takahashi, all of Hachioji, Japan

[73] Assignee: Konica Corporation, Tokyo, Japan

[21] Appl. No.: 552,763

[22] Filed: Jul. 16, 1990

[30] Foreign Application Priority Data

Jul. 18, 1989 [JP] Japan ..... 1-186895

[51] Int. Cl.[5] ..... G03G 9/087

[52] U.S. Cl. ..... 430/110; 430/109

[58] Field of Search ..... 430/109, 110

[56] References Cited

U.S. PATENT DOCUMENTS

| | | | |
|---|---|---|---|
| 4,100,087 | 7/1978 | Takayama et al. | 430/108 X |
| 4,265,992 | 5/1981 | Kouchi et al. | 430/109 X |
| 4,804,622 | 2/1989 | Tanaka et al. | 430/109 |
| 4,939,059 | 7/1990 | Kawabe et al. | 430/109 X |

*Primary Examiner*—John Goodrow

*Attorney, Agent, or Firm*—Jordan B. Bierman

[57] ABSTRACT

The improved toner for development of a latent electrostatic image contains as a binder a polyester obtained by polycondensation reaction of a monomer composition containing the specified components and it also contains an acid-modified polypropylene. This toner exhibits satisfactory fixability, developing quality, transferability, cleanability, as well as good resistance to agglomeration and toner fusion.

18 Claims, No Drawings

TONER FOR DEVELOPING LATENT ELECTROSTATIC IMAGE

BACKGROUND OF THE INVENTION

This invention relates to an agent for developing a latent electrostatic image formed on the surface of photoreceptors used in electrophotography, electrostatic recording, electrostatic printing and other reprographic methods.

Production of visible images from image information of interest is commonly accomplished by methods that involve the formation of latent electrostatic images, such as electrophotography, electrostatic recording and electrostatic printing. In electrophotography, a uniform static charge layer is first provided on the surface of a photoreceptor having a light-sensitive layer made of a photoconductive material. By subsequent imagewise exposure, a latent electrostatic image corresponding to the illuminated original is formed on the surface of the photoreceptor and then developed with a developer to form a toner image. The toner image is transferred onto a recording material such as paper and thereafter fixed by heating or pressure application to produce a copy image. After the transfer step, the photoreceptor is flooded with light to neutralize any residual charges and the toner image remaining on the photoreceptor is wiped off to condition the photoreceptor for another image cycle.

In order to insure that a copy image of high density without fog is formed over many cycles in a consistent way, the triboelectric charge on the toner particles must always be within an appropriate range. To this end, it is essential that fouling of the triboelectricity providing material or member (e.g. carrier or doctor blade) or the developer transport medium by the toner material be effectively prevented. Further, the fouling of the photoreceptor by the toner material must be prevented in order to insure an effective potential creation.

From the viewpoints of cleaning efficiency and durability, the toner that remains on the photoreceptor after the transfer step is preferably wiped off by means of cleaning with a doctor blade. However, the finer the particles of the toner that remains on the photoreceptor, the greater the force of relative adhesion to the photoreceptor and the more difficult it becomes to wipe off the toner. To prevent this problem of "insufficient cleaning", the toner is required to have good cleanability.

The toner image is preferably fixed by means of a hot pressure roll since it provides high heat efficiency and is capable of high-speed fixing. However, the use of a hot pressure roll as a fixing means has the disadvantage that "offsetting", a phenomenon in which part of the toner powder in the toner image being fixed is transferred onto the surface of the roll and is then transferred onto the recording material being sent in the next image cycle, whereby the final image is fouled. In order to prevent this trouble, the toner must have good anti-offsetting quality.

In continuous image formation, a substantial amount of heat is transferred to the recording material and the temperature of the hot pressure roll has a great tendency to drop, thus increasing the chance of the recording material of sticking to the surface of the roll. Thus, the toner is also required to have high resistance to this problem of "sticking".

With a view to satisfying the requirements described above, particularly anti-offsetting and anti-sticking qualities, it has already been proposed that a crosslinked polyester (Unexamined Published Japanese Patent Application No. 37353/1982) be used in combination with an incorporated low-molecular weight polypropylene (hereinafter abbreviated as PP; see Unexamined Published Japanese Patent Application No. 65231/1974) in toners. However, at high copying speeds or in small developing and cleaning devices, the combination of a polyester and a polypropylene has been found to be unsatisfactory since (1) the fluidity and agglomeration of toner particles is low and (2) the toner has a tendency to fuse to the triboelectricity providing material or member or the photoreceptor. This may be explained as follows: highly polar polyesters that have high contents of an ester group $$(-\underset{\underset{O}{\|}}{C}-O-),$$

a carboxyl group (—COOH) and a hydroxy group (—OH) inherently have a very small force of interfacial adhesion to the nonpolar polypropylene, so that in the process of toner production, particularly in the pulverizing and classifying steps, fine particles of polypropylene (10–30 μm) are formed to cause the problems (1) and (2) mentioned above. In addition, the dissociation of polypropylene is accelerated under the impact of compression by the cleaning blade or agitation in various pipes.

In an attempt to solve these problems, it has been proposed that polypropylene be oxidized or acid-modified to introduce carboxyl or hydroxy groups (see Unexamined Published Japanese Patent Application Nos. 54348/1983, 129863/1984, 226160/1987 and 229159/1987). However, this approach has had the following disadvantages:

a. A solid black image at the leading edge of the recording material has a great tendency to stick to the surface of a hot pressure roll;

1) combinations of acid-modified PP and common polyesters (PEs) as taught in Unexamined Published Japanese Patent Application Nos. 54348/1983, 229159/1987 and 226160/1987 have such a good miscibility between the components that phase separation does not readily occur in the fixing step, and this reduces the efficiency of paper release. This problem is particularly noticeable with a solid black image at the leading edge of paper and has been the major cause of troubles such as jamming in the fixing step;

2) the combination of an acid-modified PP and a polyester of bisphenol A type (Unexamined Published Japanese Patent Application No. 129863/1984) is a typical example of the case where the problem described in (1) is most likely to occur.

b. Fine toner particles will readily form in the developing device to impair developing, transfer and cleaning qualities;

1) methods are available that use acid-modified PPs that are highly miscible with polyesters in order to provide improved toner fluidity, agglomeration and resistance to fusion (inclusive of filming to the photoreceptor) (see Unexamined Published Japanese Patent Application Nos. 29159/1987 and 226160/1987), but polyester resins themselves are brittle and have a tendency to disintegrate to form fine toner particles in the developing device as the copying cycle is repeated; as a result, the relative adhesion between the triboelectricity providing material or member and the toner and that between the photoreceptor and the toner will increase to cause deterioration in developing, transfer and cleaning qualities; further, the fine toner particles will fuse to the triboelectricity providing material or member in copying cycles, whereby the charging ability of said material or member is reduced; and 2) the already described combination of an acid-modified PP and a polyester of bisphenol A type (Unexamined Published Japanese Patent Application No. 129863/1984) is again a typical example of the case where the problem just described above in (1) is most likely to occur.

SUMMARY OF THE INVENTION

An object, therefore, of the present invention is to provide a toner that does not permit a solid black image at the leading edge of a recording material to stick to a hot pressure roll and which has high resistance to offsetting.

Another object of the present invention is to provide a toner that has good developing, transfer, cleaning and anti-agglomeration qualities and which is effectively protected against fusion to the triboelectricity providing material or member.

In order to attain these objects of the present invention, it is important that (1) and acid-modified PP be dispersed as fine particles in a solid state and readily undergo phase separation from a polyester during fixing (by heating or pressure application) and that (2) the resin itself will not form fine particles in the developing and cleaning devices.

As regards the polyester, our intensive studies have revealed the following: (1) introducing a short-chain monomer is effective for the purpose of increasing the concentration of ester groups in the resin to thereby increase the solubility parameter; and (2) introducing an aliphatic alcohol is effective in increasing the flexibility of the polymer sequence composed of said monomer.

The above-stated objects of the present invention can be attained by a toner for development of a latent electrostatic image that contains as a binder a polyester obtained by polycondensation reaction of a monomer composition containing the components (1)–(3) described below and which also contains PP modified with a carboxylic acid or an acid anhydride thereof:

component (1): a polyvalent monomer having a valance of 3 or more;

component (2): an aromatic dicarboxylic acid;

component (3): an aliphatic dialcohol.

The polyester resin containing these components (1)–(3) may well be considered to be a binder that is optimum for use in combination with a carboxylic acid modified PP.

The acid value (AV) and the hydroxyl group value (OHV) of the polyester resin may be used as criteria for selecting an appropriate polyester resin to be combined with the acid-modified PP, and particularly preferred polyester resin is such that the sum of AV and OHV is in the range of 20–80.

The term "acid value" (AV) as used herein means the number of milligrams of the potassium hydroxide necessary to neutralize the acid contained in 1 g of the sample of polyester resin. The term "hydroxyl group value" (OHV) means the number of milligrams of the potassium hydroxide necessary to neutralize the acetic acid that binds to the hydroxyl group when it is used to acetylate 1 g of the polyester sample in accordance with "Standard Methods for Analysis and Testing of Fats and Oils" (compiled by the Japan Oil Chemists Society).

The sum of AV and OHV in a polyester means the number of terminal groups in the molecular chain of the polymer and this value has a great effect on the dispersion of the acid-modified PP. A polyester in which the value of AV +OHV ranges from 20 to 80 has good miscibility with the acid-modified PP, so that the toner in a solid state will form a fine dispersion whereas it will undergo rapid phase separation during fixing.

We have also found that not only the sum of terminal groups in the polymer chain but also their proportions are important for the miscibility of the polyester with the acid-modified PP. From this viewpoint, it is preferred to select a polyester that has an OHV to AV ratio of no more than 2.0, with the OHV/AV value of less than 1.2 being more preferred. A polyester in which the value of OHV/AV is no more than 2.0, preferably less than 1.2, has a tendency to retard self-curing during mixing and hence is capable of maintaining an adequate melt viscosity in such a way that the acid-modified PP forms a uniform fine dispersion whereas it undergoes rapid phase separation during fixing.

We have also found that the acid value of the acid-modified PP is a parameter that is important for attaining even better miscibility with the polyester specified above. The preferred acid value is in the range of 1–100, with the range of 6–50 being particularly preferred. For the purpose of providing even better cleaning and anti-fusion qualities, the acid-modified PP preferably has a penetration degree of less than 2, more preferably 1 or below. The degree of penetration is measured by the method described in JIS K 2235 (1980).

For the same reasons as described above, the acid-modified PP preferably has a hardness of at least 42 and a compressive failure stress of at least 40 kg/cm$^2$. The hardness is measured with an "Askar" rubber hardness meter (product of Kobunshi Keiki Co., Ltd.) by the method described in ASTM D 2240-68. The compressive failure stress is measured with an Autograph IS-5000 of Shimadzu Corp. under the conditions described below in accordance with JIS K 7208 (1975):

(1) shape of the sample: rectangular prism (15.0 mm×12.0 mm×37.0 mm)

(2) test speed: 10 mm/min (3) measurement temperature: 25° C.

(4) method of preparing the specimen:

i) put a powder sample into a mold having inside dimensions of 15.0 mm×12.0 mm×37.0 mm;

ii) heat the powder in a forced-air circulation dryer to a temperature that is about 10° C. above the softening point of the sample, so that it is melted and defoamed;

iii) supply an additional portion of the sample to fill the gap in the mold formed by defoaming, and remelt it; repeat this procedure until the mold is completely filled with the sample;

iv) cool the melted and defoamed sample slowly to room temperature over several hours; and v) take the sample out of the mold, shave its surface to prepare a measurement specimen in rectangular prism form having the dimensions of 15.0 mm×12.0 mm×37.0 mm.

DETAILED DESCRIPTION OF THE INVENTION

In the present invention, a monomer composition containing components (1)–(3) described above is subjected to polycondensation reaction and the resulting polyester (hereinafter sometimes referred to as "the specified polyester") is used as a binder resin.

Examples of the polyvalent monomer having a valence of 3 or more which is used as component (1) include: 1,2,4-benzenetricarboxylic acid, 1,3,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxy)methane, 1,2,7,8-octanetetracarboxylic acid, enpole trimer acid, as well as anhydrides and esters of these acids.

Among these polyvalent monomers, aromatic polyvalent carboxylic acids are particularly preferred for the purpose of preparing the polyester of the present invention which contains an aliphatic dialcohol as component (3). More preferred are benzenetricarboxylic acids such as benzenetricarboxylic acid and anhydrides or esters thereof since they are capable of providing triboelectricity in a consistent manner.

Polyesters containing aliphatic dialcohols have much fewer $\pi$ electrons than conventional polyesters containing bisphenolic alcohols and, hence, the rise speed of the electrification of such polyesters will often decrease. However, it is assumed that this problem can be prevented by selecting component (1) from among benzenetricarboxylic acids such as benzenetricarboxylic acid and anhydrides or esters thereof.

Component (1) is preferably incorporated in an amount of 1–30 mol % of the total amount of the monomer composition. The formation of fine toner particles can be prevented in a particularly effective way by using a polyester containing component (1) in an amount within the above-specified range. A more preferred range is from 1 to 15 mol % of the total amount of the monomer composition.

Examples of the aromatic dicarboxylic acid used as component (2) include phthalic acid, isophthalic acid, terephthalic acid, as well as anhydrides and esters of these acids.

Such aromatic dicarboxylic acids may be used in combination with other dicarboxylic acids including, for example, maleic acid, fumaric acid, mesaconic acid, citraconic acid, itaconic acid, glutaconic acid, cyclohexanedicarboxylic acid, succinic acid, adipic acid, sebacic acid, malonic acid, anhydrides or loweralkyl esters of these acids, dimers of linolenic acid, and other bifunctional organic acid monomers. These dicarboxylic acids are preferably incorporated in amounts of no more than 30 mol % of the total content of dicarboxylic acids.

In order to provide a toner that is more effectively protected against the fusion of fine toner particles to the triboelectricity providing material or member, the aliphatic dialcohol as component (3 ) preferably contains 2–10 carbon atoms. If the number of carbon atoms in the aliphatic dialcohol is less than 2, the molecular chain of the polyester will have only limited flexibility. If the number of carbon atoms exceeds 10, the molecular chain of the polyester will have sufficient flexibility to prevent the formation of fine particles but, on the other hand, the toner will readily undergo plastic deformation on the triboelectricity providing material or member, whereby the chance of toner fusion to said material or member is increased.

In order to insure that the formation of fine toner particles is prevented in a more effective way, it is preferred that the content of an aliphatic dialcohol having branched chains is at least 50 mol % of all the aliphatic alcohols used as component (3). The term "branched chains" as used herein means carbon chains other than the linear backbone chain that is formed of carbon atoms connected between two OH groups, as illustrated below:

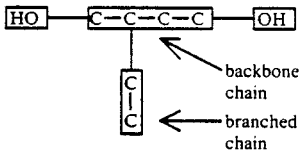

If an aliphatic dialcohol having such branched chains occupies at least 50 mol % of all the aliphatic dialcohols used as component (3), water that is to adsorb on the ester bond in the polyester is blocked by the alkyl chain, whereby the resulting water absorption is sufficiently reduced to achieve effective protection against deterioration in a moist atmosphere.

Specific examples of the aliphatic dialcohol that can be used as component (3) are listed below:

1) aliphatic dialcohols having branched chains such as propylene glycol (1,2-propanediol), 1,2-butanediol, 1,3-butanediol, 2,3-butanediol, neopentyl glycol, 3-methylpentane-1,3,5-triol, 1,2-hexanediol, 2,5-hexanediol, 2-methyl-2,4-pentanediol, 3-methyl-1,5-pentanediol and 2-ethyl-1,3-hexanediol; and 2) aliphatic dialcohols having no branched chains, such as ethylene glycol, 1,3-propanediol, 1,4-butanediol, diethylene glycol, 2-butene-1,4-diol, 1,5-pentanediol, 1,6-hexanediol, dipropylene glycol, triethylene glycol, tetraethylene glycol, tripropylene glycol, and pentaethylene glycol.

These aliphatic dialcohols may be used in combination with other dialcohols including, for example, 1,4-bis(hydroxymethyl)-cyclohexane, bisphenol A, hydrogenated bisphenol A, etherized bisphenols (e.g. polyoxyethylenated bisphenol A and polyoxypropylene bisphenol A), and other bifunctional alcoholic monomers. These dialcohols are preferably incorporated in amounts of no more than 30 mol % of all the dialcohols used. If the proportions of such "other dialcohols" are excessive, the flexibility of the molecular chain of the polyester resin is insufficient to prevent the formation of fine toner particles, whereby the durability of the developer is impaired.

The specified polyester preferably has a softening point (Tsp) of 90°–170° C., with the range of 100°–160° C. being more preferred. If the Tsp of the specified polyester is too low, the toner powder is highly likely to break into finer particles, which increases the chance of toner fusion to the surface of a triboelectricity providing material or member. Further, the anti-offsetting quality of the toner is also impaired. If, on the other hand, the Tsp of the specified polyester is excessive, its miscibility with the acid-modified PP will decrease to increase the chance of fouling of the triboelectricity providing material or member.

The softening point Tsp of the specified polymer can be measured and defined as follows: using a Kohka-type flow tester Model CFT-500 of Shimadzu Corp., a measurement is performed on a sample in an amount of 1 $cm^3$ ( in weight expressed by the true specific gravity times 1 $cm^3$) under a load of 20 $kg/cm^2$ with a nozzle of 1 mmϕ and 1 $mm^L$ at a heating rate of 6° C./min after preheating at 80° C. for 10 min: if the S portion of the resulting curve that plots temperature against the amount of drop of the plunger in the flow tester has a height h, then the temperature at the point h/2 is defined as the Tsp of the sample.

The specified polyester preferably has a glass transition point Tg of 50°-70° C. The glass transition point Tg as used herein can be measured and defined as follows: using a diffraction scanning calorimeter "Low-Temperature DSC" of Rigaku Denenki Co., Ltd., 1) put a 30-mg powder sample into an aluminum pan and heat from 20° C. to 100° C. at a rate of 10° C./min; 2) leave the sample at 100° C. for 3 min and thereafter cool with air to 20° C.; 3) and perform measurements with the temperature being elevated at a rate of 10° C./min; the temperature at the point where an extension of the base line below the glass transition point on the DSC thermogram in the glass transition region crosses the tangential line that has a maximum gradient in the region from the rising edge of the peak to its apex is defined as the Tg of the sample.

The toner of the present invention for development of a latent electrostatic image has not only the above specified polyester (i.e. binder) but also an acid-modified PP. The number average molecular weight ($\overline{Mn}$) of the acid-modified PP is preferably in the range of 500-20,000 in order to provide a good cleaning quality and to prevent a solid black image at the leading edge of a recording material from sticking to a hot pressure roll. A more preferred range of $\overline{Mn}$ is from 1,000 to 10,000.

The softening point of the acid-modified PP corresponds to its molecular weight and is preferably within the range of 100°-160° C. For the purpose of preventing a solid black image at the leading edge of a recording material from sticking to a hot pressure roll, the acid-modified PP preferably has a melt viscosity not higher than $10^4$ poises, more preferably not higher than $5\times10^3$ poises. The density of the acid-modified PP is closely related to its hardness and should preferably be at least 0.85 g/cc in order to provide good cleaning and anti-fusion qualities.

The number average molecular weight ($\overline{Mn}$) of the acid-modified PP is determined by either GPC or a vapor permeation method. Measurements of its softening point and density are performed in accordance with JIS K 2531 (1960) and JIS K 6760 (1966), respectively. The melt viscosity is represented as a value at 160° C. and measured with a Brookfield viscometer.

The acid-modified PP described above is preferably incorporated in an amount of 1-20 parts by weight per 100 parts by weight of the binder. If the proportion of the acid-modified PP is unduly small, the anti-offsetting and anti-sticking qualities of the toner will often deteriorate. If, on the other hand, the proportion of the acid-modified PP is excessive, macro-agglomerates will form in the polyester to increase the chance of fouling of the triboelectricity providing material or member.

The toner of the present invention for development of a latent electrostatic image may optionally contain additives such as colorants and charge control agents. Illustrative colorants include: carbon black, nigrosine dye (C.I. No. 50415B), aniline blue (C.I. No. 50405), chalcoil blue (C.I. No. azoic Blue 3), chrome yellow (C.I. No. 14090), ultramarine blue (C.I. No. 77103), Du Pont oil red (C.I. No. 26105), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), rose bengal (C.I. No. 45435), and mixture thereof. Colorants containing magnetic materials may also be used. These colorants are preferably incorporated in amounts of 1-20 parts by weight per 100 parts by weight of the binder.

Acidic carbon blacks having a pH of 6.5 and below have particularly good dispersibility in the specified polyester, and a desired dispersion of the acid-modified PP is insured without causing substantial agglomeration.

Known charge control agents may also be added to the toner of the present invention as required.

Further, known inorganic fine particulate matters such as silica and titanium oxide, or organic fine particulate matters such as polymethyl methacrylate and silicone resin may be externally added to the toner of the present invention as required.

While the toner of the present invention can be produced by any process, the following method may be applied with advantage: 1) mixing the above specified polyester with the acid-modified PP and any other toner components that are added as required; 2) melting and kneading the mixture; 3) cooling the melt; 4) pulverizing the cooled product; and 5) classifying it to obtain a toner having a desired average particle size.

If the toner of the present invention is to be used as a two-component developer, any kind of carrier may be selected and illustrative examples include an iron powder, a ferrite powder, as well as carriers having a styrene-acrylate copolymer, a silicone resin, etc. coated on the surfaces of these powders.

The following examples are provided for the purpose of further illustrating the present invention but are in no way to be taken as limiting.

Preparation of polyesters

The dicarboxylic acids and dialcohols shown in Table 1 (see below) were charged into a four-necked round-bottom flask (capacity, 1 L) equipped with a thermometer, a stainless steel stirrer, a nitrogen gas supply glass pipe and a reflux condenser. The flask was set in a mantle heater and heated, with an inert atmosphere being created in the flask by introducing a nitrogen gas through the $N_2$ supply pipe. Subsequently, 0.05 g of dibutyltin oxide was added and reaction was carried out at a controlled temperature of 200° C. Thereafter, the polyvalent monomer having a valence of 3 or more that is shown in Table 1 was added and further reaction was performed in obtain polyesters.

The acid value (AV), hydroxyl group value (OHV), OHV+AV, OHV/AV ratio, softening point (Tsp) and the glass transition point (Tg) of each of the polyesters obtained were as shown in Table 1.

Preparation of a comparative polyester

A reaction vessel with a stirrer that was charged with 700 g of polyoxypropylene(2.2)-2,2-bis(4-hydroxyphenyl) propane and 97.2 g of terephthalic acid was set in a mantle heater and heated, with an inert atmosphere being created in the flask by introducing a nitrogen gas through a $N_2$ supply pipe. After adding 0.05 g of dibutyltin oxide, reaction was performed at a controlled temperature of 200° C. After adding 156 g of anhydrous 1,2,4-benzenetricarboxylic acid, the reaction was further continued, whereby a polyester resin having a softening point of 120° C. and a glass transition point of 58° C. was obtained (see Unexamined Published Japanese Patent Application No. 37353/1982).

TABLE 1-1

| | Acid component | | | Alcohol component Aliphatic dialcohol | | | | | |
|---|---|---|---|---|---|---|---|---|---|
| | Polyvalent monomer | Aromatic dicarboxylic acid | | | | | | | |
| | TMA | TPA | IPA | EG | PG | NPG | 1,4-BD | DEG | TEG |
| Polyester 1 | 58 g (12%) | 381 g (88%) | — | — | 170 g (80%) | — | — | — | 84 g (20%) |
| Polyester 2 | 77 g (25%) | 315 g (75%) | — | — | — | 180 g (70%) | — | 89 g (30%) | — |
| Polyester 3 | 248 g (60%) | 125 g (35%) | 18 g (5%) | 52 g (30%) | — | 155 g (60%) | 25 g (10%) | — | — |
| Polyester 4 | 31 g (6%) | 416 g (94%) | — | 51 g (30%) | 134 g (65%) | — | 12 g (5%) | — | — |
| Polyester 5 | 58 g (12%) | 381 g (88%) | — | 68 g (40%) | 115 g (55%) | — | — | — | 21 g (5%) |

TMA: anhydrous 1,2,4-benzenetricarboxylic acid
TPA: terephthalic acid
IPA: isophthalic acid
EG: ethylene glycol
PG: propylene glycol
NPG: neopentyl glycol
1,4-BD: 1,4-butanediol
DEG: diethylene glycol
TEG: triethylene glycol

TABLE 1-2

| | OHV (KOH mg/g) | AV (KOH mg/g) | OHV + AV (KOH mg/g) | OHV/AV (−) | TG (°C.) | TG (°C.) |
|---|---|---|---|---|---|---|
| Polyester 1 | 20 | 35 | 55 | 0.6 | 62 | 141 |
| Polyester 2 | 15 | 17 | 32 | 0.9 | 60 | 140 |
| Polyester 3 | 50 | 28 | 78 | 1.8 | 57 | 135 |
| Polyester 4 | 11 | 10 | 21 | 1.1 | 61 | 125 |
| Polyester 5 | 11 | 31 | 42 | 0.4 | 59 | 144 |
| Comparative polyester 1 | 57 | 32 | 89 | 1.8 | 58 | 120 |

Preparation of acid-modified PP

Acid-modified PP-1:

A low-molecular weight ($\overline{Mn}$=4,000) (982 parts by weight) and 18 parts by weight of maleic anhydride were dissolved and dispersed in 1,500 parts by weight of xylene solvent under heating. Thereafter, 40 parts by weight of dicumyl peroxide was added as a catalyst and the mixture was heated to the boiling point of the solvent, at which temperature reaction was performed for 4 h to obtain a maleic acid modified polypropylene.

Acid-modified PP-2 to PP-6:

Additional acid-modified PPs were prepared as above.

The characteristics of the thus prepared PP-1 to PP-6 of the present invention, as well as those of comparative acid-modified polypropylenes are shown in Table 2.

Using the polyesters and acid-modified PPs described above, 6 toners of the present invention and 3 comparative toners were prepared (see Table 3) and subsequently mixed with the carriers shown in Table 4 to fabricate developers. The characteristics of these developers were then evaluated.

Preparation of toners

The toner components shown in Table 3 (polyester resin, release agent and carbon black) were mixed by means of a V-type blender, melted and kneaded with a twin-mill roll, then cooled, ground coarsely with a hammer mill, ground finely with a jet mill, and finally classified with an air classifier to prepare toner sample Nos. 1-6 having an average particle size of 11.0 μm. Each toner sample was finished by mixing with fine silica particles.

Comparative toner sample Nos. 1-3 were prepared as described above using the toner ingredients shown in Table 3.

Fabrication of developers

Each of the toners described above (72 parts by weight) was mixed with 1728 parts by weight of carrier sample Nos. 1-6 (see Table 4) in accordance with the combinations shown in Table 5, whereby two-component developers were fabricated.

The characteristics of these developers were evaluated by the methods described below and the results are shown in Table 6.

TABLE 2

| | $\overline{Mn}$* | AV (mg KOH/g) | Density (g/cc) | Tsp (°C.) | Melt index (cPs) | Degree of penetration ($10^{-1}$ mm) | Hardness (−) | Compressive failure stress (kg/cm$^2$) |
|---|---|---|---|---|---|---|---|---|
| Acid-modified PP-1 | 4000 | 18.0 | 0.89 | 148 | 600 | 0.1 | 71 | 129 |
| Acid-modified PP-2 | 1500 | 35.7 | 0.88 | 139 | 190 | 0.3 | 62 | 104 |

TABLE 2-continued

| | $\overline{Mn}$* | AV (mg KOH/g) | Density (g/cc) | Tsp (°C.) | Melt index (cPs) | Degree of penetration ($10^{-1}$ mm) | Hardness (−) | Compressive failure stress (kg/cm$^2$) |
|---|---|---|---|---|---|---|---|---|
| Acid-modified PP-3 | 3000 | 18.1 | 0.89 | 144 | 133 | 0.3 | 58 | 90 |
| Acid-modified PP-4 | 9000 | 10.2 | 0.90 | 150 | 3500 | 0.2 | 101 | 182 |
| Acid-modified PP-5 | 600 | 48.1 | 0.88 | 131 | 20 | 1.8 | 52 | 55 |
| Acid-modified PP-6 | 18000 | 6.4 | 0.91 | 159 | 8900 | 0.6 | 114 | 216 |
| Biscol TS-200 (Sanyo Chemical Industries, Ltd.) | 3500 | 3.5 | 0.89 | 145 | 120 | 2 | 41 | 35 |
| Biscol 660P (Sanyo Chemical Industries, Ltd.) | 3500 | 0 | 0.89 | 145 | 70 | 1.5 | 46 | 53 |

*Molecular weight of unmodified polypropylene

TABLE 3

| | Binder resin | Release agent | Carbon black | pH | External additive |
|---|---|---|---|---|---|
| Toner 1 | Polyester 1 | Acid-modified PP-1 (4 parts by weight) | Morgal L (Cabot Corporation) (10 parts by weight) | 3.0 | R-805 (Nippon Aerosil Co., Ltd.) (0.3 wt %) |
| Toner 2 | Polyester 2 | Acid-modified PP-2 (2 parts by weight) | PRINTEX 150T (Degussa AG) (15 parts by weight) | 5.0 | R-972 (Nippon Aerosil) (0.8 wt %) |
| Toner 3 | Polyester 4 | Acid-modified PP-3 (6 parts by weight) | RAVEN 1080 (Columbian) (7 parts by weight) | 2.4 | R-805 (Nippon Aerosil) (0.2 wt %) |
| Toner 4 | Polyester 5 | Acid-modified PP-4 (2 parts by weight) Ethylene bisstearoamide (2 parts by weight) | Morgal L (Cabot Corporation) (10 parts by weight) | 3.0 | R-805 (Nippon Aerosil) (0.4 wt %) |
| Toner 5 | Polyester 3 | Acid-modified PP-5 (2 parts by weight) | Morgal L (Cabot Corporation) (12 parts by weight) | 3.0 | R-972 (Nippon Aerosil) (0.2 wt %) |
| Toner 6 | Polyester 1 | Acid-modified PP-6 (15 parts by weight) | Morgal L (Cabot Corporation) (10 parts by weight) | 3.0 | R-805 (Nippon Aerosil) (0.6 wt %) |
| Comparative toner 1 | Comparative Polyester 1 | Acid-modified PP-1 (4 parts by weight) | Morgal L (Cabot Corporation) (10 parts by weight) | 3.0 | R-805 (Nippon Aerosil) (0.8 wt %) |
| Comparative toner 2 | Polyester 1 | Biscol TS-200 (Sanyo Chemical Industries, Ltd.) | RAVEX 1080 (Columbian) (15 parts by weight) | 2.4 | R-972 (Nippon Aerosil) (0.4 wt %) |
| Comparative toner 3 | Polyester 1 | Biscol 660P (Sanyo Chemical Industries, Ltd.) | PRINTEX 150T (Degussa AG) (7 parts by weight) | 5.0 | R-972 (Nippon Aerosil) (0.6 wt %) |

TABLE 4

| | Core | Particle size (μm) | Resin coat |
|---|---|---|---|
| Carrier 1 | Cu—Zn containing ferrite | 80 | Methyl methacrylate/ styrene copolymer (60/40) |
| Carrier 2 | Cu—Zn containing ferrite | 120 | Methyl methacrylate/ styrene copolymer (60/40) |
| Carrier 3 | Cu—Zn containing ferrite | 60 | Silicone resin (SR-2400 of Toray Silicone Co., Ltd.) |
| Carrier 4 | Ni—Zn containing ferrite | 80 | Silicone resin (SR-2400 of Toray Silicone Co., Ltd.) |
| Carrier 5 | Ni—Zn containing ferrite | 40 | Methyl methacrylate/ styrene copolymer (70/30) |
| Carrier 6 | iron | 80 | Methyl methacrylate/ styrene copolymer (70/30) |

TABLE 5

| Developer | Toner | Carrier |
|---|---|---|
| 1 | Toner 1 | 1 |
| 2 | Toner 2 | 2 |
| 3 | Toner 3 | 3 |
| 4 | Toner 4 | 4 |
| 5 | Toner 5 | 5 |
| 6 | Toner 6 | 6 |
| Comparative developer 1 | Comparative toner 1 | 1 |
| Comparative developer 2 | Comparative toner 2 | 1 |
| Comparative developer 3 | Comparative toner 3 | 1 |

TABLE 6

| | Sticking temperature (°C.) | Hot offsetting temperature (°C.) | Cleaning quality Initial | $10^5$ cycles | $2 \times 10^5$ cycles | Image density | Fog density | Transfer efficiency (%) | Toner agglomeration (%) | Toner fusion (wt %) |
|---|---|---|---|---|---|---|---|---|---|---|
| Developer 1 | 165 | 250< | ○ | ○ | ○ | 1.21 | 0.001 | 94 | 3 | 0.009 |
| Developer 2 | 160 | 250< | ○ | ○ | ○ | 1.20 | 0.003 | 98 | 2 | 0.012 |
| Developer 3 | 165 | 250< | ○ | ○ | ○ | 1.24 | 0.002 | 91 | 8 | 0.015 |
| Developer 4 | 165 | 250< | ○ | ○ | ○ | 1.18 | 0.002 | 95 | 2 | 0.008 |
| Developer 5 | 160 | 250< | ○ | ○ | ○ | 1.05 | 0.008 | 88 | 10 | 0.056 |
| Developer 6 | 175 | 250< | ○ | ○ | ○ | 1.20 | 0.003 | 96 | 5 | 0.010 |
| Comparative developer 1 | 205 | 210 | ○ | X | X | 0.68 | 0.031 | 52 | 46 | 0.208 |

TABLE 6-continued

| | Sticking temperature (°C.) | Hot offsetting temperature (°C.) | Cleaning quality | | | Image density | Fog density | Transfer efficiency (%) | Toner agglomeration (%) | Toner fusion (wt %) |
|---|---|---|---|---|---|---|---|---|---|---|
| | | | Initial | $10^5$ cycles | $2 \times 10^5$ cycles | | | | | |
| Comparative developer 2 | 185 | 220 | ○ | Δ | X | 0.80 | 0.020 | 61 | 33 | 0.195 |
| Comparative developer 3 | 185 | 225 | ○ | X | X | 0.52 | 0.058 | 40 | 62 | 0.340 |

Note: The developers fabricated in accordance with the present invention performed satisfactorily without causing "toner filming" or the photoreceptor.

Evaluation of fixability

1. Sticking temperature

A solid black and unfixed image was formed at the edge of receiving sheet on U-Bix 5070 (Konica Corp.). The toner deposit was controlled at 1.0 mg/cm$^2$.

The receiving sheet was passed through a fixing unit (for its specifications, see Table 7 below), with the temperature of the upper roll being lowered from 220° C. by decrements of 5° C., and the temperature at which the receiving sheet started to stick to the upper roll was designated as the "sticking temperature". The lower this temperature, the better the performance of the toner used. The temperature of the lower roll was set to be 20° C. lower than the temperature of the upper roll.

2. Hot offsetting temperature

A solid black and unfixed image (10 mm×10 mm) was formed on receiving sheet on U-Bix 5070 (Konica Corp.). The toner deposit was controlled at 1.0 mg/cm$^2$.

The receiving sheet was passed through a fixing unit (for its specifications, see Table 7 below), with the temperature of the upper roll being raised from 200° C. by increments of 5° C., and the temperature at which hot offsetting started to occur was designated as the "hot offsetting temperature". The higher this temperature, the better the performance of the toner used. The temperature of the lower roll was set to be 20° C. lower than the the temperature of the upper roll.

TABLE 7

| | |
|---|---|
| Upper roll dia. | 60 mm |
| material of the surface layer | perfluoroalkoxy resin |
| Lower roll dia. | 65 mm |
| material of the surface layer | perfluoroalkoxy resin |
| Nip width | 9 mm |
| Time of residence in the nip | 30 msec |
| Surface pressure | 2 kgf/cm$^2$ |
| Others | In the absence of both oil applicator and cleaning member |

Copying test with actual machine

Using an electrophotographic copier adapted from U-Bix 5070 (Konica Corp.) that was equipped with an As-Se photoreceptor, a contact type magnetic brush developer (for normal development), a hot pressure roll type fixing unit, and a cleaning device having a urethane rubber cleaning blade, a running test was conducted for a total of $2\times10^5$ copying cycles consisting of intermittent copying (a copying mode in which one copy was taken for one sheet of document) and continuous copying. The copying conditions were either is a hot and humid atmosphere (33° C.×80% r.h.) or in a cold and dry atmosphere (10° C.×20% r.h.). Similar results were attained under either conditions. The results obtained in a hot and humid atmosphere are shown in Table 6 as typical examples of evaluation.

1. Cleaning quality

The toner that remained on the surface of the photoreceptor after cleaning and the fouling of image due to insufficient cleaning were visually checked at the initial time and after copying through $10^5$ and $2\times10^5$ cycles. The results were evaluated by the following criteria.

| | | Fouling of image due to insufficient cleaning | |
|---|---|---|---|
| | | Negative | Positive |
| Residual toner on photoreceptor | Negative | ○ | — |
| | Positive | Δ | X |

2. Image density and fog density

The solid black area of each copy image (the area corresponding to a document density of 1.3) and the white background (the area corresponding to a document density of 0.0) were subjected to measurements of reflection density with a Densitometer of Konica Corp. The results are designated "image density" and "fog density", respectively.

Measurements on Developers 1-6 and Comparative Developers 1-3 at the initial time were satisfactory: image density ≧1.30 and fog density ≦0.005. Thus, only the results of measurements made after $2\times10^5$ cycles are shown in Table 6.

3. Transfer efficiency

Transfer efficiency (%) was measured after $2\times10^5$ cycles. This parameter is express by:

$$\text{Transfer efficiency (\%)} = \frac{\text{Amount (g/cm}^2\text{) of toner transferred to receiving sheet}}{\text{Amount of toner (g/cm}^2\text{) transferred to photoreceptor}} \times 100$$

4. Toner agglomeration

After copying through $2\times10^5$ cycles, a sample of the toner that exactly weighed 2 g was taken out of the cleaning device and put into a 10-cc sampling tube. A specimen was prepared by tapping the sample tube 500 times in a Tapdenser (Seishin Kigyo Co., Ltd.). The specimen was left to stand in a hot and dry atmosphere (60° C.×26% r.h.) for 2 h and sieved through the 48-mesh screen on a Powder Tester (Hosokawa Micron Co., Ltd.) at an intensity of 4 for 30 sec. The percent toner aggomeration was determined from the percent residual toner which was calculated by the following equation:

$$\text{Residual toner (\%)} = \frac{a}{2} \times 100$$

where a is the amount of residual toner in grams.

5. Toner fusion

The amount of toner fusion was measured by the following procedure:

(i) after copying through $2\times10^5$ cycles, about 10 g of the developer was sampled from the developing unit;

(ii) the developer was washed with water containing a surfactant, whereby the statically deposited toner was removed;

(iii) the carrier in the toner sampled in step (i) was dried at 40° C. for 24 h and a portion of the dried carrier was measured in an amount that exactly weighted 3 g;

(iv) the toner fused to the carrier was dissolved away with methyl ethyl ketone, and the carrier was again dried at 40° C. for 24 h to measure its weight, a;

(v) the percent carrier coverage after $2\times10^5$ cycles was calculated by the following equation:

$$b = \frac{3-a}{3} \times 100 \text{ (wt \%)}$$

(vi) the initial percent carrier coverage minus b was defined as the amount of toner fusion.

As Table 6 shows, the developer samples fabricated in accordance with the present invention exhibited satisfactory fixability (i.e., high resistance to sticking and offsetting), developing quality, transferability, cleanability, as well as good resistance to agglomeration and toner fusion.

What is claimed is:

1. A toner for development of a latent electrostatic image that contains as a binder a polyester having a ratio of hydroxyl group value (OHV) to acid value (AV) not exceeding 1.2 obtained by polycondensation reaction of a monomer composition containing the components (1)-(3) described below and which also contains a polypropylene modified with a carboxylic acid or an acid anhydride thereof:

component (1): a polyvalent monomer having a valence of 3 or more;

component (2): an aromatic dicarboxylic acid; and component (3): a dialcohol containing at least 70 mol % of aliphatic dialcohol.

2. A toner according to claim 1 wherein the sum of acid value (AV) and hydroxyl group value (OHV) of said polyester is in the range of 20-80.

3. A toner according to claim 1 wherein said component (1) is selected from the group consisting of esters and anhydrides of benzene tricarboxylic acid.

4. A toner according to claim 1 wherein said acid-modified polypropylene has an acid value of 1-100.

5. A toner according to claim 1 wherein said acid-modified polypropylene has a hardness of at least 42.

6. A toner according to claim 1 wherein said component (1) is an aromatic polyvalent carboxylic acid having a valence of 3 or more.

7. A toner according to claim 6 wherein said aromatic polyvalent carboxylic acid is a benzenetricarboxylic acid.

8. A toner according to claim 1 wherein component (1) occupies 1-30 mol % of the monomer composition.

9. A toner according to claim 1 herein component (2) is selected from the group consisting of phthalic acid, isophthalic acid, terephthalic acid, and anhydrides or esters thereof.

10. A toner according to claim 1 wherein component (3) has 2-10 carbon atoms.

11. A toner according to claim 10 wherein at least 50 mol % of all the aliphatic dialcohols used as component (3) is occupied by an aliphatic dialcohol having a branched chain.

12. A toner according to claim 1 wherein said polyester has a softening point of 90°-170° C.

13. A toner according to claim 1 wherein said polyester has a glass transition point of 50°-70° C.

14. A toner according to claim 1 wherein said acid-modified polypropylene has a softening point of 100°-160° C.

15. A toner according to claim 1 wherein said acid-modified polypropylene has a melt index of no more than 104 poises.

16. A toner according to claim 1 wherein said acid-modified polypropylene is incorporated in an amount of 1-20 parts by weight per 100 parts by weight of the binder.

17. A toner according to claim 1 which contains a colorant.

18. A toner according to claim 1 which has an inorganic or organic fine particulate matter added externally.

* * * * *